United States Patent [19]

Koerner et al.

[11] Patent Number: 4,894,175

[45] Date of Patent: Jan. 16, 1990

[54] CRUDE OIL WITH A DEPRESSED POUR POINT

[75] Inventors: Götz Koerner; Dietmar Schaefer, both of Essen; Roland Berger, Bochum; Hans-Ferdi Fink; Heinz Dumm, both of Essen, all of Fed. Rep. of Germany

[73] Assignee: Th. Goldschmidt AG, Essen, Fed. Rep. of Germany

[21] Appl. No.: 157,734

[22] Filed: Feb. 18, 1988

Related U.S. Application Data

[62] Division of Ser. No. 27,518, Mar. 18, 1987, abandoned.

[30] Foreign Application Priority Data

Apr. 29, 1986 [DE] Fed. Rep. of Germany ..... 3614412

[51] Int. Cl.[4] ..... C10M 1/50; H01B 3/20

[52] U.S. Cl. ..... 252/78.3; 252/49.9; 208/14; 208/18; 137/13

[58] Field of Search ..... 252/78.3, 49.4; 208/14, 208/18; 137/13

[56] References Cited

U.S. PATENT DOCUMENTS

| | | | |
|---|---|---|---|
| 3,308,145 | 3/1967 | Lentz | 252/78.3 |
| 3,320,297 | 5/1967 | Pino | 252/78.3 |
| 3,652,627 | 3/1972 | Meiller | 252/78.3 |
| 4,058,546 | 11/1977 | Knollmueller | 252/78.3 |
| 4,462,921 | 7/1984 | Peterson et al. | 252/78.3 |
| 4,537,691 | 8/1985 | Mori et al. | 252/78.3 |
| 4,564,467 | 1/1986 | Rauline | 252/78.3 |
| 4,612,134 | 9/1986 | Pierce et al. | 252/78.3 |
| 4,640,792 | 2/1987 | Goenhof et al. | 252/78.3 |

FOREIGN PATENT DOCUMENTS 0113597 7/1984 European Pat. Off. .

*Primary Examiner*—Helane Myers

*Attorney, Agent, or Firm*—Toren, McGeady & Associates

[57] ABSTRACT

Disclosed are pour point depressants of the general, average formula

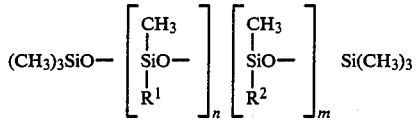

in which $R^1$ is alkyl with 18 to 36 carbon atoms with the proviso, that at least 40% of the alkyl groups have at least 22 carbon atoms, $R^2$ is hydrogen, methyl or an entity containing polar groups, it being possible for $R^2$ to have different meanings within the average molecule, $N \geqq 30$ and $M = 0$ to $n/2$.

Also disclosed are crude oils containing from 0.005 to 0.15 weight percent of the above compounds and a process for reducing the pour point of crude oils by incorporating therein said compounds, optionally in a solvent.

12 Claims, No Drawings

CRUDE OIL WITH A DEPRESSED POUR POINT

This is a division of application Ser. No. 027,518 filed Nov. 18, 1987 now abandoned.

FIELD OF THE INVENTION

The invention relates to crude oil with an improved flow behavior, especially a depressed pour point, due to the addition of organosilicon compounds; to such compounds and to a process for reducing the pour point of crude oils.

BACKGROUND OF THE INVENTION

It is well known that organosiloxanes which have long-chain alkyl groups linked to silicon atoms may be added to oils to depress their pour points. For example, DD Patent No. 115,916, teaches such additions to improve the cold behavior of liquid mineral oil products, especially of crude oil distillates such as diesel fuels, light heating oils and vacuum distillates, by adding thereto linear poly-n-alkyl-methyl-siloxanes of the formula $(CH_3)_3Si—[OSi(CH_3)R]_n—OSi(CH_3)_3$ with $n \leqq 10$ or cyclic poly-n-alkyl-methyl-siloxanes $[OSi(CH_3)R]_m$ with $m=3$ to 10 or mixtures of both classes of materials, in which R is a long-chain n-alkyl group with a chain length of $C_{10}$ to $C_{24}$ and preferably of $C_{10}$ to $C_{20}$. These additives are added to the mineral oil products in a concentration of 0.01 to 0.5 weight percent.

European OLS No. 0,113,579 describes an oil preparation, which comprises a greater amount of an oil having a viscosity of 5 to 30 cSt at 40° C. and a lesser amount of an organopolysiloxane, the organopolysiloxane having the following formula:

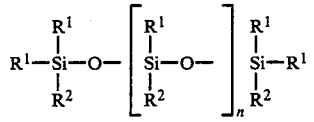

In this formula, $R^1$ is methyl, ethyl or propyl, $R^2$ is alkyl with 10 to 20 carbon atoms and n is a number from 12 to 28. The organopolysiloxanes depress the pour point of light mineral oil, their other important utilities especially their electrical properties, not being affected by the addition of the siloxanes. In particular, the dielectric losses, when the oils are used as insulating oils, are not increased by the addition of the siloxanes.

These organopolysiloxanes, known in the art, are however not or only insufficiently suitable for depressing the pour point of crude oil with a high paraffin content, especially a paraffin content of $\geqq 10$ weight percent. These paraffin-containing crude oils are extracted in very different oil fields, such as in India, in certain fields in the North Sea, in Egypt, the USA and Argentina and, because of their high pour point, cause considerable difficulties during transport and processing. These difficulties may be observed particularly in those crude oils, which contain n-paraffins with an average number of carbon atoms of $\geqq 20$. Admittedly, the pumpability of such crude oils may be improved by raising the temperature. This measure, however, frequently is frustrated by economic considerations or local factors. For example, it is hardly possible to heat pipelines which are laid under water.

OBJECT AND SUMMARY OF THE INVENTION

The main object of this invention is to depress the pour point of mineral oils having a high paraffin content to such an extent that their processing is facilitated or, in the extreme case, even becomes possible. Moreover, the substances added to depress the pour point should be effective in very small amounts and it should be possible to synthesize them by inexpensive methods known in the art.

In its product aspect, the the invention resides in pour point, depressants of the general formula

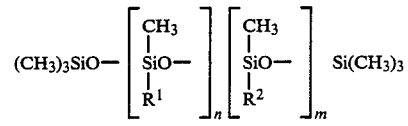

I in which $R^1$ is alkyl with 18 to 36 carbon atoms with the proviso, that at least 40% of the alkyl groups have at least 22 carbon atoms, $R^2$ is hydrogen, methyl or an entity containing polar groups, it being possible for $R^2$ to have different meanings within the average molecule, $n \geqq 30$ and $m=0$ to $n/2$.

The invention also comprises crude oils containing from about 0.005 to 0.5 weight percent of the above compounds. In its process aspect the invention resides in a process for reducing the pour point of crude oils by incorporating therein said compounds.

The structure of the $R^1$ group is an important characteristic of the siloxanes of formula I. This $R^1$ group is an alkyl group with 18 to 36 carbon atoms. At least 40% of the alkyl groups should have 22 or more carbon atoms.

These siloxanes may be obtained using known methods by the addition reaction of $\alpha$-olefins with 18 to 36 carbon atoms or a mixture of $\alpha$-olefins with the desired number of carbon atoms with the appropriate hydrogen-siloxanes, in which $R^1$ is hydrogen. In accordance with the state of the art, the $\alpha$-olefins are added in the presence of a platinum catalyst, for example $H_2PtCl_6$.

DISCLOSURE OF BEST MODES OF THE INVENTION

The organopolysiloxanes of formula I must have at least 30 methylsiloxy units which carry the $R^1$ group. This means that, on a statistical basis no organopolysiloxanes, which contain exclusively $R^1$ having fewer than 22 carbon atoms, are contained in the organopolysiloxane mixture.

The upper limit for the number n of $CH_3R^1SiO$ substituents mainly is determined only by the availability of the hydrogen polysiloxanes required for the synthesis of these compounds. The subscript n may therefore have numerical values of 100 and more. Preferred are siloxanes of the average formula I, in which n has a value of 30 to 200, especially of 30 to 100 and particularly of 30 to 70.

The organopolysiloxane of the average formula I may have a number of additional $CH_3R^2SiO$ units corresponding to the subscript m, $R^2$ being hydrogen, which originates from unreacted SiH groups of the hydrogensiloxane used as starting compound, or also methyl. Due to the incorporation of dimethylsiloxy units, the melting point of the siloxanes of formula I is depressed and, with that, the metered addition of the siloxanes to and their mixing with the crude oil is facilitated. $R^2$ may also be a substituent with polar groups. Such $R^2$ substituents with polar groups may improve the effectiveness of the siloxanes and their solubility in inert auxiliary solvents, such as toluene or xylene. This is of particular advantage if the siloxanes are used in the form of concentrated solutions in the auxiliary solvents. The number of such substituents is determined by the subscript m, which may have a value from 0 to n/2. Concentrated solutions are preferred for use in highly viscous crudes.

Examples of such polar groups are polyoxyalkylene monoalkanol or polyoxyalkylene monoether groups, polyalkylene polyamine groups, alkoxy groups, alkylcarboxylic acid groups and esters or amide groups derived therefrom. These polar groups may be linked to the silicon atom by way of a carbon, oxygen, sulfur or nitrogen atom. Preferably, these polar groups are linked to silicon atoms by a bivalent hydrocarbon group, especially an alkylene group. Examples of polar groups linked to a silicon atom are the $—M(C_xH_{2x}O)_yR^3$ groups, in which M is oxygen or a bivalent hydrocarbon group and $R^3$ is hydrogen or alkyl, x may have a value of 2, 3 or 4 corresponding to the number of oxyethylene, oxypropylene or oxybutylene groups contained in the oxyalkylene block and $y \geqq 1$. It should, however be noted in this connection that the solubility or dispersibility of the products in the crude oil must be maintained. Such polar groups may be obtained, for example, by adding polyoxyalkylene ethers of allyl alcohol in the same manner as the aforementioned α-olefins to SiH groups of the starting siloxane. In this case, M is a bivalent hydrocarbon group. Compounds, in which M is oxygen, may be obtained by reacting polyoxyalkylene monoethers with the hydrogensiloxane used as starting material, hydrogen being split off.

Further examples of polar groups linked to a silicon atom are groups of the general formula $—Q(C_xH_{2x}NR^4)_yR^5$, in which $R^4$ and $R^5$ are hydrogen or alkyl and Q is $NR^4$— or a bivalent hydrocarbon group, x and y being defined as above.

An example of a further polar group is the alcohol group ROH, which may be obtained, for example by the addition reaction of allyl alcohol to the hydrogensiloxane. Moreover, the terminal hydroxyl group may be etherified or esterified. It is furthermore possible to add unsaturated acids and especially their esters, such as methyl undecylenate, to the hydrogensiloxane, in order to introduce a polar group into the siloxane molecule by these means.

Within the average molecule, $R^2$ may have different meanings; for example, up to 30 mole percent $R^2$ may be hydrogen and up to 70 mole percent a polar group.

As a result of the different compositions of the crude oils obtainable in the various oil fields, it is advisable to determine the most effective siloxanes of formula I by preliminary experiments. Those skilled in this art are familiar with procedures for carrying out such preliminary experiments to determine the most effective products.

The organopolysiloxanes of formula I are effective when added in an amount of about 0.005 to 0.5 weight percent, based on the crude oil.

The activity of the siloxanes of formula I for depressing the pour point is shown by the following comparative examples given as non-limiting embodiments of the invention.

The pour point is determined with the Stockpunkt-Automat MC 850 of the Herzog company, Lauda. The use of this instrument permits the pour point to be determined with a higher accuracy than is possible with the pour point determination method of ASTM D-97. In this connection however, it should be noted that the pour point, measured by the ASTM method, can be only a few °C. above or below the pour point measured with the Stockpunkt-Automat MC 850. Since the present investigations are comparison measurements, measurement with the aforementioned instrument was preferred for reasons of better reproducibility.

For the measurement of the pour point with the Stockpunkt-Automat MC 850, a sample of the oil, whose pour point is to be determined, is heated to a specified starting temperature and then cooled in a thermostatted vessel at a specified cooling rate. The measurement is based on the principle that the oil sample to be measured is rotated at a rate of less than one revolution per minute; when the pour point is reached, a pendulum immersed in the sample is deflected.

An initial temperature of 60° C. is selected for the comparative measurements.

The following crude oils from different sources are used for the measurement of the pour points:

Crude oil 1: Indian crude oil; pour point=30° C.
Crude oil 2: North Sea crude oil; pour point=20° C.
Crude oil 3: Egyptian crude oil; pour point=16° C.
Crude oil 4: Indian crude oil: pour point=25° C.

The following selected compounds are used as pour point depressants:

| Example | $R^1$ (average number of carbon atoms) | $R^2$ | n | m |
|---|---|---|---|---|
| I | 23 | — | 50 | 0 |
| II | 26 | $—CH_3$ | 45 | 15 |
| III | 26 | $—(CH_2)_3OCOCH_3$ | 40 | 13 |
| IV | 28 | $—(CH_2)_3O(C_2H_4O)_{12}CH_3$ | 40 | 8 |
| V | 26 | — | 50 | 0 |

The following were added to the crude oil as comparison compounds:

| Example | $R^1$ (average number of carbon atoms) | $R^2$ | n | m |
|---|---|---|---|---|
| VI | 14 | — | 8.3 | 0 |
| VII | 16 | — | 8.3 | 0 |
| VIII | 14 | — | 20 | 0 |
| IX | 16 | — | 20 | 0 |
| X | 18 | — | 20 | 0 |
| XI | 20 | — | 20 | 0 |

In each case, 0.015 weight percent of compounds I to XI are added to crude oils 1 and 4 and 0.03 weight percent to crude oils 2 and 3. The following pour points are measured, the data being rounded off to the nearest whole number.

| Example | | Crude Oil 1 | Crude Oil 2 | Crude Oil 3 | Crude Oil 4 |
|---|---|---|---|---|---|
| I | of the invention | 20 | — | — | 15 |
| II | of the invention | 22 | — | — | 13 |
| III | of the invention | 21 | — | — | 14 |

-continued

| Example | | Crude Oil 1 | Crude Oil 2 | Crude Oil 3 | Crude Oil 4 |
|---|---|---|---|---|---|
| IV | of the invention | — | 16 | 10 | — |
| V | of the invention | 22 | 12 | 8 | 17 |
| VI | not of the invention | 28 | 20 | 16 | 25 |
| VII | not of the invention | 29 | 19 | 16 | 25 |
| VIII | not of the invention | 27 | 19 | 16 | 25 |
| IX | not of the invention | 27 | 20 | 16 | 25 |
| X | not of the invention | 26 | 19 | 15 | 24 |
| XI | not of the invention | 27 | 19 | 15 | 21 |
| no addition | | 30 | 20 | 16 | 25 |

It is evident from the Table that the siloxanes of formula I of the invention are superior to the comparison substances in effectiveness in a surprising and unforeseeable manner.

Further examples performed as above with the following compounds:

| Example | $R^1$ | $R^2$ | n | m |
|---|---|---|---|---|
| A | 26 | $-(CH_2)_3O(C_2H_4O)_{3.5}H$ | 40 | 10 |
| B | 26 | $-(OC_2H_4)_8OCH_3$ | 40 | 10 |
| C | 26 | $-OC_2H_5$ | 45 | 15 |
| D | 26 | $-(CH_2)_{10}COOH$ | 53 | 7 |
| E | 26 | $-(CH_2)_{10}COOCH_3$ | 53 | 7 |
| F | 26 | $-(CH_2)_{10}CONH(CH_2)_3N(CH_3)_2$ | 53 | 7 |

The compounds are added to crude oil 4 in amounts of 0.015 weight percent. The following pour points are measured:

| | °C. |
|---|---|
| Compound A | 13 |
| Compound B | 14 |
| Compound C | 12 |
| Compound D | 14 |
| Compound E | 14 |
| Compound F | 19 |

While there have been described herein what are at present considered preferred embodiments of the invention, it will be obvious to those skilled in the art that minor modifications and changes may be made without departing from the essence of the invention. It is therefore to be understood that the exemplary embodiments are illustrative and not restrictive to the invention, the scope of which is defined in the appended claims and that all modifications that come within the meaning and ranges of equivalency of the claims are intended to be included therein.

What is claimed is:

1. A crude oil having a depressed pour point, containing from about 0.005 to about 0.5 weight percent of a pour point depressant compound of the general formula:

$$(CH_3)_3SiO-\left[\begin{array}{c}CH_3\\|\\SiO-\\|\\R^1\end{array}\right]_n\left[\begin{array}{c}CH_3\\|\\SiO-\\|\\R^2\end{array}\right]_m Si(CH_3)_3$$

in which $R^1$ is alkyl with 18 to 36 carbon atoms with at least 40% of the alkyl grous having at least 22 carbon atoms, $R^2$ is hydrogen, methyl or a substituent containing polar groups, with $R^2$ being the same or different within the average molecule, $n \geqq 30$ and $m=0$ to $n/2$; and mixtures thereof.

2. A crude oil according to claim 1, with a paraffin content of at least 10 percent in which said polar group is selected from the group consisting of polyoxyalkylene monoalkanol, polyoxyalkylene monoether, alkoxy, alkylcarboxylic acid, alkylcarboxylate ester, alkylcarboxylic acid amide and alkanol ester groups.

3. The oil of claim 2, wherein sid polar groups are linked to silicon atoms by a bivalent hydrocarbon group or a carbon, oxygen, sulfur or nitrogen group.

4. The oil of claim 3, wherein said hydrocarbon group is an alkylene group.

5. The oil of claim 2, wherein said polar group is defined by the formulas:

$$M(C_xH_{2x}O)_yR^3$$

wherein

M is oxygen or a bivalent hydrocarbon group and $R^3$ is hydrogen or alkyl;

x is 2 to 4 and $y \geqq 1$; and $-Q(C_xH_{2x}NR^4)_yR^5$ wherein $R^4$ and $R^5$ are hydrogen or alkyl and Q is $NR^4$— or a bivalent hydrocarbon group, with x and y being as above defined.

6. The oil of claim 2, wherein $R^2$ consists of up to 30 mole percent of hydrogen and up to 70 mole percent of a polar group.

7. The oil of claim 2, wherein n ranges from 30 to 200.

8. The oil of claim 2, wherein n ranges from 30 to 100.

9. The oil of claim 2 wherein n ranges from 30 to 70.

10. A process for reducing the pour point of a crude oil which comprises mixing with said oil and intimately dispersing therein at least one compound of the general formula $$(CH_3)_3SiO-\left[\begin{array}{c}CH_3\\|\\SiO-\\|\\R^1\end{array}\right]_n\left[\begin{array}{c}CH_3\\|\\SiO-\\|\\R^2\end{array}\right]_m Si(CH_3)_3$$

in which:

$R^1$ is alkyl with 18 to 36 carbon atoms with at least 40% of the alkyl groups having at least 22 carbon atoms, $R^2$ is hydrogen, methyl or a substituent containing polar groups, with $R^2$ being the same or different within the average molecule, $n \geqq 30$ and $m=0$ to $n/2$.

11. The process of claim 10, wherein said compound is defined by the formula

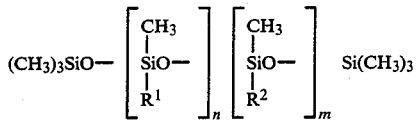

in which:

$R^1$ is an alkyl group with 18 to 36 carbon atoms with at least 40% of the alkyl groups having at least 22 carbon atoms, $R^2$ is hydrogen, methyl or a polar group with $R^2$ being the same or different within the average molecule, and said polar group being selected from the group consisting of polyoxyalkylene monoalkanol, polyoxyalkylene monoether, alkoxy, alkylcarboxylic acid, alkylcarboxylate ester, alkylcarboxylic acid amide and alkanol ester groups, $n \geqq 30$ and $m = 0$ to $n/2$.

12. The process of claim 10, wherein said compound is dissolved in an inert solvent.

* * * * *